United States Patent [19]

Ringe

[11] Patent Number: 4,523,881

[45] Date of Patent: Jun. 18, 1985

[54] LATERAL FORCE SYSTEM AND SUPPORT FOR SUPPORTING MINE ROOFS

[75] Inventor: Thomas Ringe, Phoenixville, Pa.

[73] Assignee: Mine Roof Support Systems, Inc., Spring City, Pa.

[21] Appl. No.: 481,377

[22] Filed: Apr. 1, 1983

[51] Int. Cl.[3] ..... E21D 20/00; E21D 21/00

[52] U.S. Cl. ..... 405/259; 411/80

[58] Field of Search ..... 405/259, 260, 261; 411/75–80

[56] References Cited

U.S. PATENT DOCUMENTS

| | | | |
|---|---|---|---|
| 922,980 | 5/1909 | Vernon et al. | 411/78 |
| 3,301,123 | 1/1967 | Worley | 405/259 X |
| 3,521,522 | 7/1970 | Zoldok | 411/75 |

FOREIGN PATENT DOCUMENTS

| | | | |
|---|---|---|---|
| 440772 | 1/1936 | United Kingdom | 411/80 |
| 711324 | 6/1954 | United Kingdom | 411/80 |
| 120201 | 8/1958 | U.S.S.R. | 411/80 |

*Primary Examiner*—Dennis L. Taylor

[57] ABSTRACT

A system and support means for creating lateral and compressive forces in and for supporting mine roofs, and particularly in coal mines and the like, where the roofs frequently include, at least in part, layers of rock and shale in overlying strata, and are notoriously weak in tensile and shear strength. A plurality of individual support means or members are inserted vertically into holes bored in the mine roof, and each includes expansion means, operable by bolt means available below the mine roof, to activate the expansion means to thereby create lateral and compressive support forces within the various strata layers, thereby so strengthening the roof structure as to prevent collapse of a mine roof or portions thereof.

8 Claims, 8 Drawing Figures

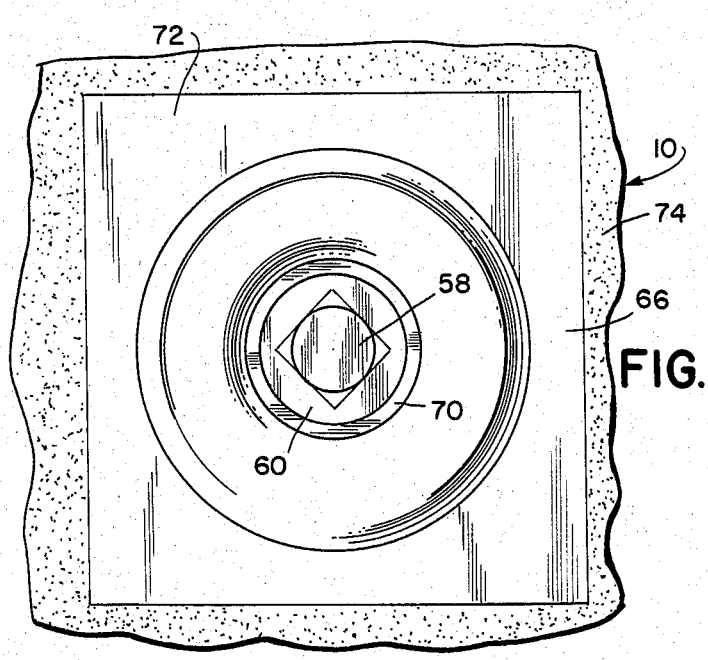
FIG. 4
FIG. 5
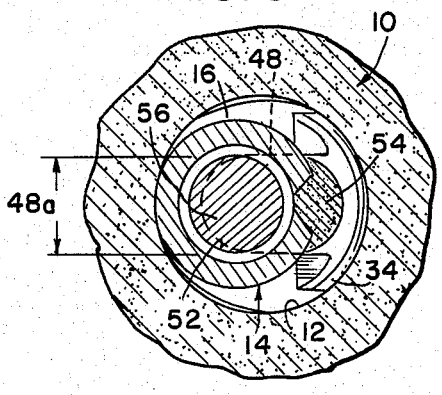
FIG. 6
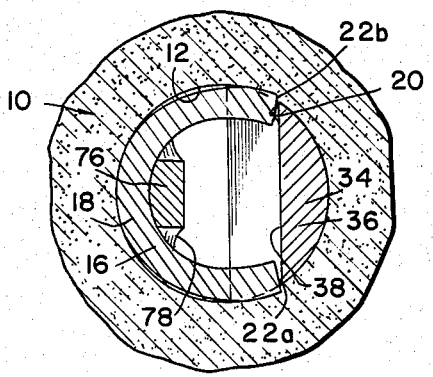
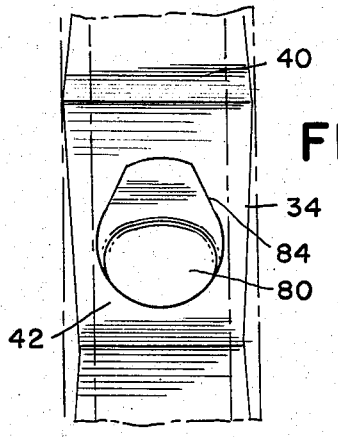
FIG. 7

LATERAL FORCE SYSTEM AND SUPPORT FOR SUPPORTING MINE ROOFS

TECHNICAL FIELD

The present invention relates generally to underground mining, and more especially to support of overhead ceilings or roofs in the underground passageways of mines. It is well known and recognized that mine roofs, especially those of coal mines, tend to have structural weakness due to the composition of overlying strata, which frequently includes shale which is notoriously weak in tensile and shear strengths.

Numerous failures and collapses of mine roofs of this type have heretofore seriously jeopardized the lives of men working in underground mines. The solution to the problem of providing safe and adequate roof support is a very serious one and has been longstanding.

An ancient type of roof support in mines utilized timbers and similar support members including masonry walls and arches, steel timber sets, metal props, steel and masonry supports and others. Such installations are not only comparatively expensive due to material support costs but are increasingly costly due to installation costs, including labor. Such previously used support means have also been found in many instances to be inefficient and cave-ins have resulted.

More recent developments in the area of mine roof support means and systems have used elongated roof bolts which are inserted into openings drilled in the strata above the roof of mine passageways at predetermined spaced-apart intervals. One type heretofore used included anchor-like fastening means at one end adjacent the uppermost part of a hole and means at the opposite end of the bolt to place the bolt under tension. While it was believed that use of this arrangement would result in compressive forces vertically and simulate a thicker and stronger overhead strata, this type of bolt in use was not completely satisfactory. Compression of strata vertically while at least partially compensating for tension component of shear, did not adequately compensate for the compression component. Other drawback results of this type of anchor were found in use, including installation where soft strata areas tended to create anchor slippage, tending to cause support failure, and anchor slippage frequently resulted in complete failure of roof support.

Other types such as block wedges were heretobefore used but again failed to completely and satisfactorily maintain safe mine roof supports and were unsuitable for reuse.

A still further type was an expansion bolt incorporating an internally threaded wedging plug. This type was not only complicated in structure but in usage. This type provided relatively small contact areas with the walls of roof holes and, particularly when used in soft strata materials, there was a slippage tendency which led to roof failure.

PRIOR ART

Many other types have heretobefore been utilized. The most successful types of anchor bolts and mine roof support systems heretobefore used and known are of the types shown in U.S. Pat. Nos. 3,301,123, issued Jan. 31, 1967 and 3,496,754, issued Feb. 24, 1970, and a pending application for U.S. patent entitled SUPPORT MEANS AND SYSTEM FOR SUPPORTING MINE ROOFS, Ser. No. 294,735, filed Aug. 20, 1981, now U.S. Pat. No. 4,415,294 in the name of Thomas Ringe, Each of the prior patents and pending application, and the apparatus and devices taught therein provide mine roof bolts broadly comprised of a pair of elongated members of coacting stepped configurations in the nature of undulating or curvilinearly waved surfaces, the two members being, in an assembled and nested relationship inserted into pre-drilled holes in mine roofs. Subsequent rectilinear relative movements of the two members engaged the side walls of the holes and created forces within the overlying strata which resulted in strong resistance to strata movement, and for the most part were satisfactory as a system and support means for supporting mine roofs.

While these prior known and used roof bolt structures have proven, at least in part, successful, it has been found that improvements are desirable to create entirely satisfactory results in use.

The present invention is primarily directed to providing mine roof supports which overcome the drawbacks of the prior known art and principally constitutes an improvement over the aforesaid pending application, Ser. No. 294,735.

BACKGROUND OF THE INVENTION

A high percentage of mines have a shale roof weak in tensile and shear strengths. Known types of roof bolts and support means, including expansion-shell and resin bolts do not work well in this type of material. Resultant failure and roof falls can be extensive, expensive and dangerous to miners. Attempts have been made to utilize composite or plural bolting systems simultaneously, such as, for example, expansion-shell or resin bolts with a truss system to combat the problem but difficulties are still encountered.

The tendency of a mine roof to sag between the ribs of the pillars after the coal has been mined is principally a shearing action. Shear has a tension component and a compression component. These two components must be supported or a mine roof will tend to fall. Some rock, such as limestone and sandstone, usually have sufficient tensile and shear strength to support the roof without additional support. Where shale exists in the overlying strata, however, and which is typically weak in tensile and shear strength, heretofore known and used roof supporting systems are not only tested severely but frequently have failed. It is known that shale constitutes a large percentage, for example up to approximately 50%, of roofs immediately above coal seams.

Known and heretofore used installations have not accommodated the various forces which occur or exist in mine roofs and will not accommodate both the shear within the beam and the compression component.

While the mine roof bolts taught in the above-mentioned U.S. patents and pending application have, for the most part, proven to be at least partially satisfactory in use, areas for improvement were noted in one particular form of roof bolt.

Basically, the present invention improves the form of roof bolt disclosed in the above patents and application. The forms of the disclosed invention comprise two members, one being a body member constituted by a bar of generally U-shaped cross-section having longitudinal spaced-apart side edges, with a stepped edged configuration defining a plurality of angular, longitudinally spaced cam surfaces. The edges generally were of an undulating or wavilinear configuration, and a coactive solid slide member was formed to a generally similar coactive shape having an inner surface or face of a configuration comparable generally to the wavilinear configuration or undulation of the edges of the U-shaped body member.

In use, the two members in a stacked or nested configuration were inserted into a pre-drilled hole or opening in the roof strata and then axially or linearly displaced, one with respect to the other, into an expanded position wherein the opposing outer surfaces of the members were displaced laterally, due to their configuration, into pressure-applying relation with the side wall of the opening in the roof strata.

These prior types of construction in use were capable of easy and quick installation, and easily removable after a period of time for reuse. These roof bolts firmly gripped the strata of the roof, essentially throughout their length which normally was, for practical reasons, limited to approximately 30" to 3' and effectively eliminated anchor slippage and minimized harmful effects of bolt elongation. Roof bolts of this type, in use, at least partly pre-stressed the strata or layers of materials above the roof laterally and generally provided some measure of support of compression and tension components of shear stress in the roof layers.

The present invention while directed to a somewhat similar construction or concept as described above, and particularly as disclosed in the co-pending application, incorporates improvements thereover not only in construction, but in functional overall operation of the roof bolts, and a system of bolt use, resulting in improved roof support.

The expansion sheath of the prior types had application limitations, including force components, and specific areas of use, and limited lengths.

SUMMARY OF THE INVENTION

The present invention, accordingly, is broadly directed to mine roof bolts of an improved nature and to mine roof support utilizing such bolts, the end result constituting a substantial improvement in the art as will appear hereinafter.

More specifically, the present invention discloses a particular improvement in that type of roof bolt which includes the generally hollow or open faced U-shaped body member and coactive solid slide bar member, with the interacting undulating or stepped wavilinear edge configurations which cooperate or coact to create a plural force system necessary for adequate and appropriate mine roof support.

The present invention teaches a roof bolt construction, and an improved system of use. The bolts include a pair of coactive elongated steel members. One member, being termed the body member, has a generally U-shaped configuration with one substantially even rectilinear surface, and opposed thereto there are inturned longitudinal edges of a generally undulating or stepped wavilinear configuration, and with the apex portions thereof slightly inturned. A coactive slide member is formed from a partial round bar shaped to a generally serpentine shape, of a generally similar stepped wavilinear configuration, and having an inturned lower end extendable into the lower open portion of the U-shaped body member. The lower end of the U-shaped body member is closed as be welding, and tapped with internal threads. An elongated bolt, having a threaded end, is passed through an apertured plate adapted for engagement with the under surface of a mine roof surrounding a vertical bore formed therein for insertion of the roof bolt, and is adjustably engaged in the tapped threads, and provided with a head extended beyond and operatively engageable with the plate exterior surface.

The members, as generally similar to the above mentioned prior art, are operatively intermeshed in use following insertion in a hole in the mine roof and, upon actuation, with the slide member being rectilinearly moveable with respect to the body member. Intercoaction of the stepped wavilinear configuration creates a lateral separation of the two members, and thereby creating a lateral compression force in the material surrounding the bolt. The two coacting members are known in the art as an expansion shell. Turning of the bolt serves to draw down on the body member, and displaces it in effect downwardly with respect to the slide member to effect the lateral expansion of the so-called shell. The slide lower inturned end initially serves to prevent displacement, as by turning, or otherwise, of the slide member, and thereafter a continued tightening of the bolt creates a compressive force acting on the vertical stacked array of material layers or strata forming the roof, between the expansion shell and plate placed beneath the surface of the area being supported. In effect, therefore, the present invention not only creates a lateral force in the area surrounding the bolt, but additionally the structure is such that the shell can be placed wherever desired, including remote areas of the bore provided for insertion of the bolt. A selective area of lateral force is thereby obtained, and also the structure between the shell and the base plate, at the bottom of the bolt, creates compressive forces in the layers and area therebetween. In other words the present device, in addition to features hereinafter to be explained, provides plural actions including a suspension at desired heights, a clamping of the strata layers to create the compressive forces, and a lateral force beam or vector which puts the roof components into lateral compression.

The individual mine roof bolts include means to prevent lateral movement, relative rotation or slippage between the two bolt members. This is accomplished by providing interior projections or protrusions on the slide member which are confined, operatively, within and between the eges of the generally U-shaped body member, and which are guidedly constrained as the two members are rectilinearly or axially moved with respect to one another to create the forces as described. Lateral slippage between such members can result in failure of appropriate and efficient action of the roof bolts. Such slippage would tend to cause or result in possible disengagement between the camming surfaces which provide the lateral expansion and lateral forces. It is to be noted that there is relatively small movement between the two members comprising an individual mine bolt, i.e., a portion of a single land or step, and it is within this small movement that lateral slippage or displacement must be prevented. Use of this configuration is, therefore, highly desirable and provides a high degree of satisfaction in installation and use. Once a longitudinal force has been applied, the chances of slippage are substantially eliminated.

The present invention and application, as mentioned, supports mine roofs by providing a lateral force system which supports the compression component of shear. At the same time the bolts bond the rock layers together vertically for supporting the tension component of shear. To this end the bolts of the invention can be so disposed as to create a force pattern arrangement with improved resultant overall roof support.

Still other objects and advantages of the present invention will become readily apparent to those skilled in the art from the following detailed description, wherein there is shown and described preferred embodiments of the invention, simply by way of illustration of a preferred mode presently contemplated for carrying out the invention. As will be realized, the invention is capable of other and specifically different embodiments, and its several details are capable of modifications in various, obvious respects, all without departing from the invention. Accordingly, the drawings and description are to be regarded merely as illustrative in nature, and not as restrictive.

BRIEF DESCRIPTION OF THE DRAWING

The accompanying drawings illustrate a preferred embodiment of the invention and, when taken together with the description, serves to explain the principles of the invention.

FIG. 4 is a bottom plan view of a portion of a mine roof and applied bolt structure taken along line 4—4 of FIG. 3*a;*

FIG. 5 is an enlarged fragmentary sectional view taken on line 5—5 of FIG. 3*a;*

FIG. 6 is an enlarged fragmentary sectional view taken on line 6—6 of FIG. 3*a;* and FIG. 7 is an enlarged fragmentary view, partially in section, taken along line 7—7 of FIG. 3*a.*

DETAILED DESCRIPTION OF PREFERRED EMBODIMENT

Figure 1:
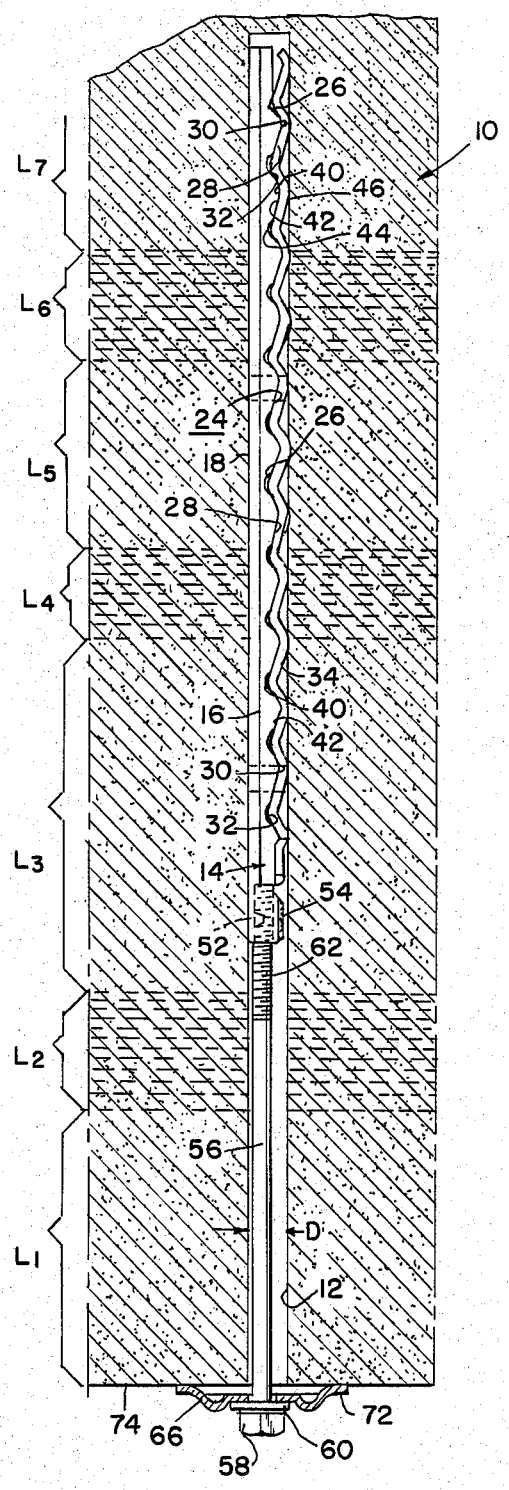
FIG. 1 shows a section of mine roof strata with a bolt operatively positioned in a hole therein, the bolt being in accordance with the present invention.

Referring now in detail to the drawings, and particularly FIG. 1, there is shown a portion of a mine roof generally designated 10 and consisting of a plurality of layers of different materials, the layers being designated $L_1$, $L_2$, $L_3$, $L_4$, $L_5$, $L_6$, $L_7$, $L_8$, and specifically defining different material such as, for example, shale, sandstone, lime, and the like as normally present in mine roof strata.

In accordance with the teachings of the invention a hole or opening 12 is drilled vertically upwardly into the material of the mine roof strata and is generally circular and of a diameter indicated by arrows at D. The size of the opening is just sufficient to easily insert therein a mine bolt, generally designated 14 in accordance with the teachings of the invention.

The basic details of the structure of the bolt, shown in some detail in the drawings is generally similar to that shown in the above mentioned prior art and, therefore, a reiterative description in detail is not felt necessary herein. Reference is made to, and the disclosures of said aforementioned patents and co-pending application are incorporated herein by reference, it being noted that a common ownership is present.

The bolt 14 includes a pair of coactive elongated steel members. A body member or portion 16 is of a general U-shaped configuration having a curvilinear closed side 18, which is the rear side having a substantially straight longitudinal surface, and an open face at 20. It will be seen from FIGS. 5 and 6 of the drawings that the body member 16 while being of a generally U-shaped configuration has the free edges 22*a*, 22*b* thereof slightly inwardly curved and defining therebetween a distance slightly less than the diameter of the overall U-shaped portion of body member.

The free edges 22*a*, 22*b* are configured to form an undulating or stepped wavilinear configuration broadly indicated at 24, thereby creating a plurality of individual angularly disposed longitudinally spaced substantially planar surfaces 26, 28 (FIG. 3*a*) and intermediate curvilinear apexes and bases 30, 32, respectively. It will be noted that the edges are generally of a curvilinear rather than a sharply breaking configuration.

The body is formed of an appropriate steel and body blanks can be formed from a flat into a rounded, substantially U-configured, elongated shape with the aid of dies. The sharp edges of the body can be smoothed with a coining die.

A slide member 34 formed from a partial round bar, shaped over dies, has imparted thereto a generally serpentine shape, again of a generally stepped wavilinear configuration broadly similar to that of the body edges 22*a*, 22*b* and in cross-section is of a generally cylindrical segmental configuration as broadly shown at 36 in FIG. 6. The inner surface 38 of the slide member has a width substantially of the same dimension as the overall outer width formed by the edges 22*a*, 22*b* of body member 16 and the slide is adapted for sliding coactive movement along the edges of the body member, all as set forth in the above mentioned prior art patents and application. The curvilinear configuration of the slide member again consists of a plurality of substantially flat spaced planar surfaces 40, 42 (FIG. 3*b*) and with intermediate curvilinear apexes 44 and curvilinear bases 46. The overall mating or coacting configurations of the body member and slide member are similar, it being noted that the curvilinear bases 32 of the body member are slightly deeper than the dimension of the coacting curvilinear apex 44 of slide 34.

The slide 34 can be formed in a manner known in the art from a half-round shape from pallets from a steel mill. Details of a method are given in the co-pending application. The pallets are cut and shaped over dies into the serpentine shape as shown, and an inturned end portion 48 is provided at one end. It will be noted that the lower bent end 48 can be at a right angle and have a width 48*a* slightly smaller than the remainder of the slide. The smaller width facilitates insertion of the bent end into the opening between adjacent edges of the U-shaped body 16 for purposes hereinafter to be explained.

Opposed lower ends 50 of body 16 are further rolled or bent inwardly to form an opening which is closeable into, for example, a $\frac{3}{4}''$ or $\frac{5}{8}''$ size hole, as indicated at 52. The openings between the ends, as rolled, is welded as at 54, and the hole as formed is then tapped or threaded internally at 52 with an appropriate thread dimension and style.

A square headed rod or bolt 56, the square head being indicated at 58, together with a washer-like portion 60, has a threaded end portion 62, the thread and dimension of the bolt being commensurate with those of the internal threads 52 in the lower portion of body member 16. The upper free end 64 is adapted for operative engagement with the lower surface of the bent portion or end 48 of the slide member 34 and serves in conjunction therewith, during actuation of the bolt member to initially seat those portions of the slide and body in contact with the bore. This serves to start a tightening process or expansion. Once it starts to grip the serpentine plural surfaces, and starts to grip the rod, then any additional tendency of the tab to bend is not critical. When the bolt is tightened, there is a downward pull placed upon the body portion as the bolt is actuated or rotated in its threaded engagement in the body member. A slight displacement between the body member and slide then initiates the expansion action due to the curvilinear segments or portions thereof sliding or moving with respect to, and on, one another. As noted, the tab portion 48 initially prevents a spinning or turning of the shell portions in the roof, and once tightening is initiated and the roof is gripped the tab is no longer required. When turning the bolt, the body member is actually being pulled down so that it is expanded downward. As a matter of fact, once expansion of the shell is initiated, it is a downward expansion, as opposed to an up or down movement of the shell and its components conjointly.

Figure 3A:
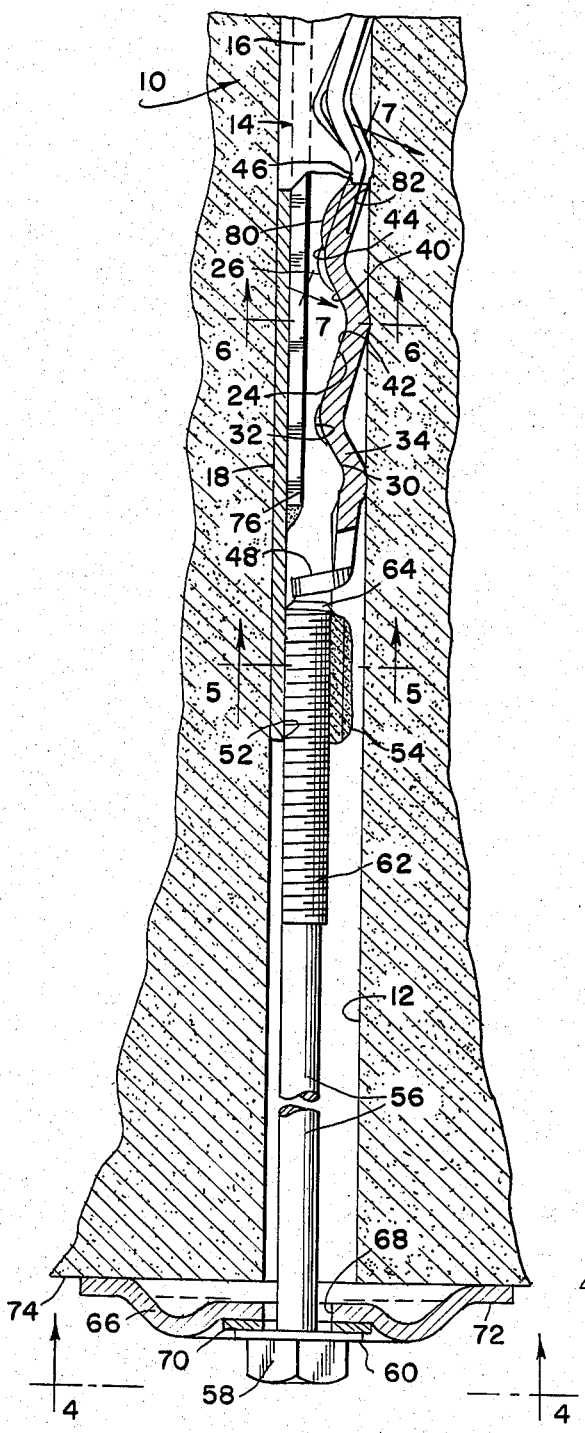
FIG. 3*a* is an enlarged fragmentary view taken along line 3*a*—3*a* of FIG. 2 and disclosing details of and actuating means for a bolt prior to actuation.

By reference to FIG. 3*a* it will be seen that a plate 66 has a central opening 68 of a diameter greater than the diameter of bolt 56, and preferably a washer 70 is interposed between the head 58 of the bolt and the exterior of plate 66. Plate 66 also has, preferably, a flat peripheral contact flange 72 for engagement with the under surface 74 of the mine roof. The relative sizes of the opening 68 and bolt 56 permit a tilting of plate 66 to accommodate it to uneven surfaces. This is of substantial significance due to usually uneven or rough surfaces found in mine roofs.

Figure 3B:
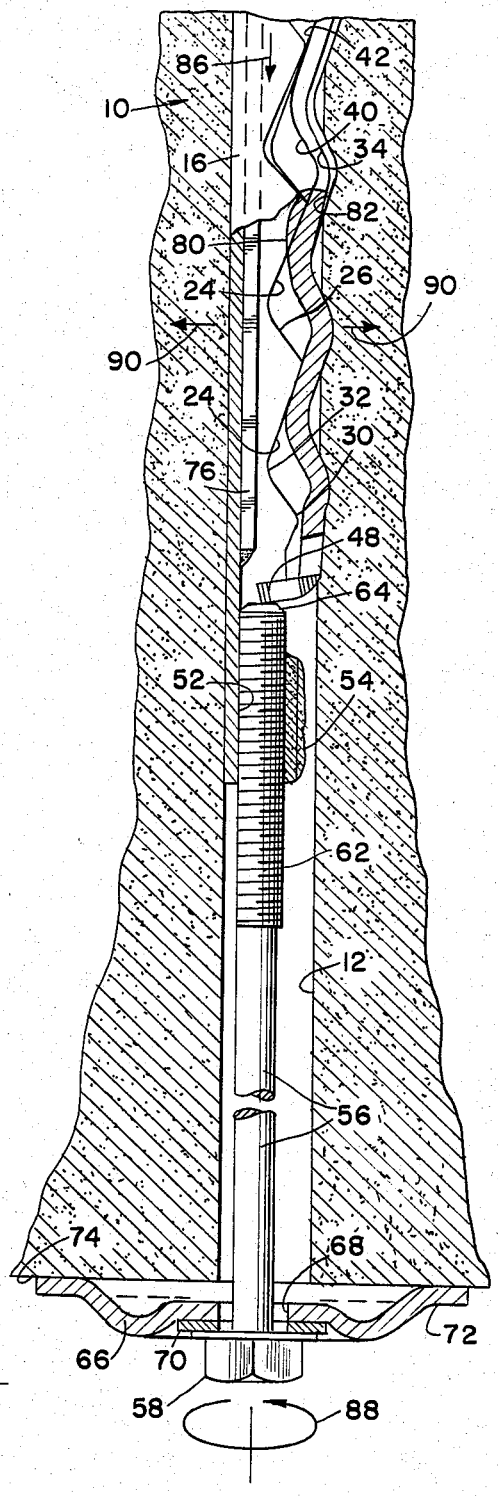
FIG. 3*b* is a view similar to FIG. 3*a* but disclosing a condition wherein the bolt has been activated, and discloses the application of forces to a portion of mine roof strata as will be hereinafter explained.

Attention is also invited to FIGS. 3*a*, 3*b* and 6, wherein there is shown a rectilinear rod-like member 76, welded to the interior base of U-shaped body member 16 as at 78. This rod 76 serves as a strengthening member.

Figure 2:
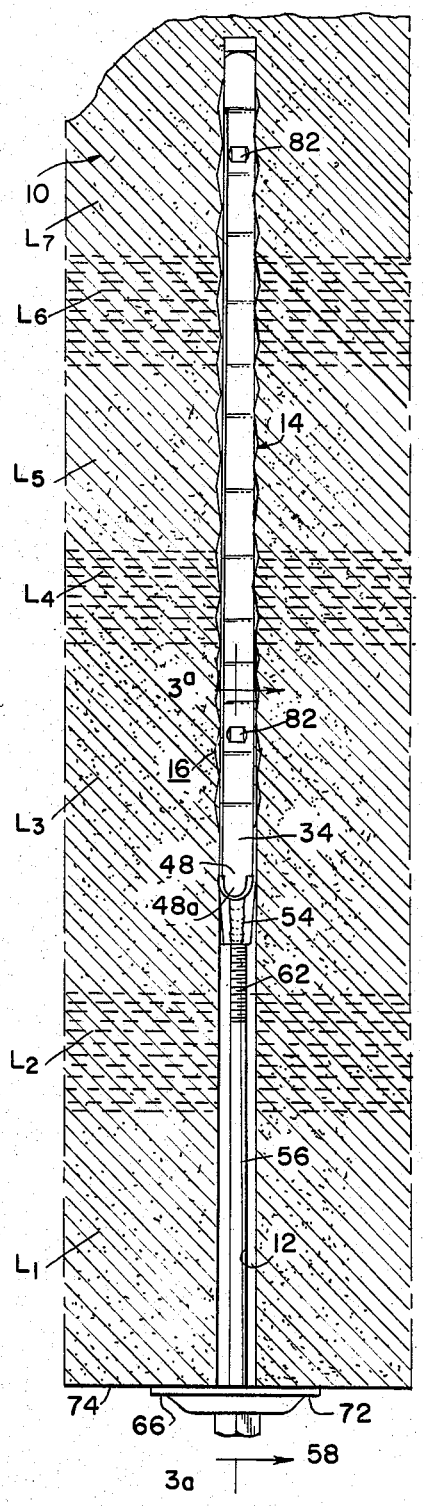
FIG. 2 is an elevational view taken at right angles to the showing of FIG. 1.

Due to the dimensions between the opposed edges of the open body member 16 and the external dimension of the slide member 34 as pointed out above, as also the general configuration thereof, there is always a possibility that the two members can become laterally displaced with respect to one another, i.e., the slide can have one edge thereof slide or slip into the interior of the U-shaped configuration of the body member. This would destroy function of the roof bolt as will be obvious. In order to obviate this, and of extreme importance to functioning of the present invention, there are provided the inwardly extending protrusions 80 on the inner surface of the slide 34 on spaced ones of the flat planar surfaces. These protrusions 80 are formed by punching of the slide member at 82 in a known manner. As shown in FIGS. 2, 3*a*, 3*b*, these protrusions 80 on the inner surface of the slide 34 are of a generally oval shape and have tapering longitudinal ends at 84 and substantially square side edges. This configuration provides for ease of movement of the slide with respect to the body member, with the straight side edges preventing displacement upon rectilinear sliding movement between the members as indicated by arrow 86 (FIG. 3*b*), upon actuation of the bolt. It has been found that a protrusion or interior projection provided at spaced positions, near the upper and lower ends of slide members 34 serve the desired function thereof.

In practice, the bolt in a nested position can have the body and slide jointed together temporarily by means of flex tapes for the function of initially assembling the two members together as a unit for insertion into openings provided in the mine roof. Thereafter these tapes will not serve any function.

Subsequent to insertion of the bolt means into the openings and upon applying a turning torque to bolt head 58, as shown by arrow 88, the upper surface of plate 66, being in contact with the undersurface of the mine roof, the body member 16 is pulled downwardly and in effect resulting in respective axial or lineal relative motion between the body member 16 and slide 34. Due to the configuration of the respective mating surfaces of these two members, a lateral separating force is applied. The direction of lateral force application is noted by a direction of force indicator arrows 90.

In action, when the bolt means are expanded by tightening activation, the coal mine roofs are supported by placing the roof rock in sufficient lateral and vertical compression through the application of lateral force to prevent weak laminated shale, for example, from sagging or moving. The bolt means exert a pair of forces in opposite directions, and the extent of the force will vary depending upon the material of the strata. A random or haphazard installation of bolts can be used, producing random directions of force, or by selective orienting they can expand to produce forces in desired directions. The bolts if oriented to exert forces perpendicular to the walls for example will contribute compressive stress at vertical shear planes, and thus serve to lessen a tendency for shear failure at these planes.

In addition to the aforementioned action in reinforcing a mine roof, similar in many respects to the aforementioned prior art, the present invention permits a placement of the so-called shell, or the active area of the expansion, or lateral force system bolt in any desired location in the bore formed in the mine roof. In effect this permits building a thicker beam to create more support in the roof. In other words, if a 6 foot bolt is used in the present apparatus a thicker beam is provided since the rock is being pulled together over this area, and this constitutes an improvement over, for example, a 30 to 40 inch beam as suggested in the prior art patents. A bolt sufficiently long can be used to fit the situation involved, and to vary the placement of the shell and thereby vary the overall beam dimensions. The roof is effect is clamped together over the entire length of the bolt and additionally the lateral expansion is provided where desired.

Previously a relatively short bolt member was utilized regardless of roof conditions. The present construction permits a substantial improvement over that limitation. A beam of lateral forces is created, dependent upon the placement and length of the expansion shell, and additionally an overall beam is formed because of the clamping action of the bolt members, with a plate pulling against the shell or anchor, and the entire area of the roof between the anchor and plate is put under compression. This is referred to in the art as clamping, and when laminations are clamped together the friction developed prevents a sagging action between layers, with the friction between the layers resisting movement therebetween, or with respect to each other.

Recapitulating, and in essence, therefore, the advantages of the present invention over the known prior art resides in many areas. There are no threads sticking down from the device which might tend to injure workers. By use of different lengths of bolts, strengthening of roof lengths can be varied from, for example, 30" to 20' or longer. The bolts tighten easily, and the use of the free moving plates permit tightening under uneven roof conditions. As the bolts are tightened, by a tightening of the rod head, this creates a pulling action on the body downwardly and the slide is in effect pushed upwardly. This results in a tightening of the bolt in the hole. The bolt stays tight in the hole, and torque losses are reduced. Additionally, roof weight on the plate serves to tighten the anchored bolt, and high loads at low torque conditions on the bolt can occur. Suspension is provided at desired heights, and clamping of strata layers, and lateral force beams to put the roof rock into compression are attainable. The bolt structure is safe in use, and relative costs, as regards other devices, are comparable.

The structure, system, function and advantages of the present invention will be readily understandable from the foregoing description of a preferred embodiment when taken together with the drawings.

Many other possible variations in specifics of components or details of the invention will be apparent to those skilled in the art. While in the present disclosure, there are shown preferred embodiments of the invention, it is to be understood that the invention is capable of changes or modifications without departing from the spirit and the scope of the inventive concept as expressed herein.

What is claimed is:

1. A supportive force applying bolt for mine roofs adapted for insertion in a vertical hole in a said roof, said bolt comprising a generally U-shaped body member with laterally spaced front edges, said front edges being of continuous smoothly undulating extended stepped wavilinear configurations, a slide member having both longitudinal faces with a continuous smoothly undulating stepped wavilinear configuration similar to that of said body member edges in mating coactable engagement therewith, rotatable means operatively connected to the lower end of said body member and operatively engageable with the lower end of said slide member, said rotatable means being operable to cause relative displacement between said body and slide members through a downward movement of said body member with respect to said slide member, said members upon opposite relative displacement moving and displacing said mating stepped surfaces from low to high portion contact therebetween serving to laterally relatively space said members and create lateral oppositely directed forces against plural contacted side portions of the hole, and thereby lateral opposite forces in the proximate material of said mine roof, said rotable means being in coactive engagement with the mine roof surface adjacent said vertical hole and operable upon rotation to contactably set and position said slide member against material in said hole and to create vertical compressive forces in the mine roof material through coactive downward movement of said slide body and positioned contact of said rotatable means with the mine roof surface.

2. A supportive force applying bolt for mine roofs as claimed in claim 1, said rotatable means comprising an elongated bolt means in screw threaded engagement in the lower end of said body member with a free inner end thereof in contacting engagement with the lower end of said slide member, the lowermost head end of said bolt means extending out of said hole, and washer means disposed between said head end and mine roof surface to facilitate rotation of said bolt and application of said compressive forces through the medium of said washer means.

3. A supportive force applying bolt for mine roofs as claimed in claim 2, the lower end of said body member being externally compressed in a manner to form an elongated hole of a preselected internal diameter of a size commensurate with the external diameter of said rotatable bolt means, said elongated hole being tapped for operative insertion and engagement therein of a screw threaded inner end of said bolt means.

4. A supportive force applying bolt for mine roofs as claimed in claim 3, said washer means having a flat face portion in engagement with said mine roof surface around said hole, a central opening in said washer means of a diameter greater than the diameter of said bolt means and adapted to accommodate positionment of said washer means against an uneven said mine roof, with the bolt means head in operative engagement with the opposite face of the washer means.

5. A supportive force applying bolt as claimed in claim 4, said slide member having an inturned lower end segment extending into the interior of said U-shaped body member above the tapped lower end thereof, said free inner end of said bolt means being in operative engagement with said inturned lower end segment, said bolt free end and said inturned end coacting to initially create a binding positioning engagement of a second said slide member face of a similar configuration with the opposite face thereof, and thereby permit downward movement of said body member to create the lateral forces on the material on the mine roof exterior of said hole.

6. A supportive force applying bolt as claimed in claim 5, said bolt means having a non-threaded intermediate portion loosely engaged through said central washer opening.

7. A supportive force applying bolt as claimed in claim 6, wherein a longitudinally extending body member reinforcing rod is operatively positioned in the interior bottom of the U-shape and secured therein.

8. A supportive force applying bolt as claimed in claim 7, further including protrusion means on said slide member extending into the open interior of said body member and operable to prevent lateral movement therebetween prior to application of turning and tightening force on said bolt means.

* * * * *